US007323815B2

(12) United States Patent
Perlo et al.

(10) Patent No.: US 7,323,815 B2
(45) Date of Patent: Jan. 29, 2008

(54) LIGHT-EMITTING DEVICE COMPRISING POROUS ALUMINA, AND MANUFACTURING PROCESS THEREOF

(75) Inventors: Piero Perlo, Sommariva Bosco (IT); Nello Li Pira, Fossano (IT); Marzia Paderi, Turin (IT); Piermario Repetto, Turin (IT); Vito Guido Lambertini, Giaveno (IT); Mauro Brignone, Orbassano (IT); Rossella Monferino, Turin (IT)

(73) Assignee: C.R.F. Società Consortile per Azioni, Orbassano (Torino) (IT)

( * ) Notice: Subject to any disclaimer, the term of this patent is extended or adjusted under 35 U.S.C. 154(b) by 290 days.

(21) Appl. No.: 11/081,665

(22) Filed: Mar. 17, 2005

(65) Prior Publication Data

US 2005/0206306 A1 Sep. 22, 2005

(30) Foreign Application Priority Data

Mar. 18, 2004 (EP) ..... 04425192

(51) Int. Cl.
*H01J 1/62* (2006.01)

(52) U.S. Cl. ..... 313/504; 313/506

(58) Field of Classification Search ..... 313/310
See application file for complete search history.

(56) References Cited

U.S. PATENT DOCUMENTS 6,464,853 B1 * 10/2002 Iwasaki et al. ..... 205/118
6,992,436 B2 * 1/2006 Seo ..... 313/504

FOREIGN PATENT DOCUMENTS

EP 1 385 041 1/2004

OTHER PUBLICATIONS

Kukhta et al, "Porous Alumina Based Cathode for Organic Light-Emitting Devices", Proceedings of the SPIE, SPIE, Bellingham, VA, US, vol. 4105, Jul. 31, 2000, pp. 405-412.
Rabin et al, "Formation of Thick Porous Anodic Alumina Films and Nanowire Arrays on Silicon Wafers and Glass", Advanced Functional Materials, Wiley Intersciences, Wienheim, DE, vol. 13, No. 8, Aug. 2003, pp. 631-638.
Kokonou et al, "Structural and photoluminescence properties of thin alumina films on silicon, fabricated by electrochemistry", Materials Science and Engineering B, Elsevier Sequoia, Lausanne, CH, vol. 101, No. 1-3, Aug. 15, 2003, pp. 65-70.
Shingubara et al, "Formation of Al Dot Hexagonal Array on Si Using Anodic Oxidation and Selective Etching", Japanese Journal of Applied Physics, Publication Office Japanese Journal of Applied Physics, Tokyo, JP, vol. 41, No. 38, Part 2, Mar. 15, 2002, pp. L340-L343.

(Continued)

*Primary Examiner*—Vip Patel
(74) *Attorney, Agent, or Firm*—Nixon & Vanderhye P.C.

(57) ABSTRACT

A light emitting device comprises a substrate, a porous alumina layer having a regular series of cavities of nanometric size containing an emitting material, and two electrodes in contact with the emitting material and connected to an electric voltage source. The first electrode comprises at least part of an aluminum film deposited onto the substrate, on which the alumina layer has been previously grown through an anodization process.

13 Claims, 3 Drawing Sheets

OTHER PUBLICATIONS

Masuda et al, "Photonic Crystal Using Anodic Porous Alumina", Japanese Journal of Applied Physics, Publication Office Japanese Journal of Applied Physics, Tokyo, JP, vol. 38, No. 12A, Part 2, Dec. 1, 1999, pp. L1403-L1405.

Gaponenko et al, "Photoluminescence of Eu-doped titania xerogel spin-on deposited on porous anodic alumia", Sensors and Actuators A, vol. 99, No. 1-2, Jun. 5, 2001, pp. 71-73.

* cited by examiner

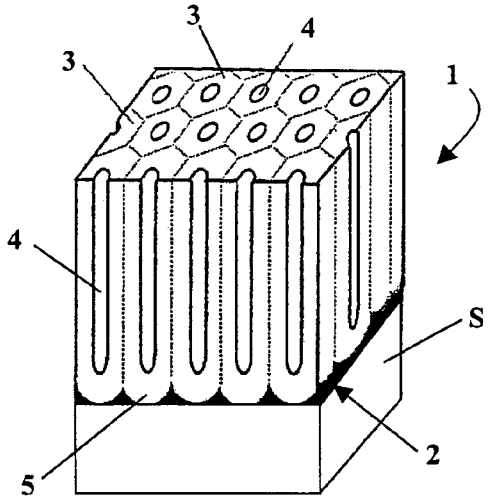
Fig. 1
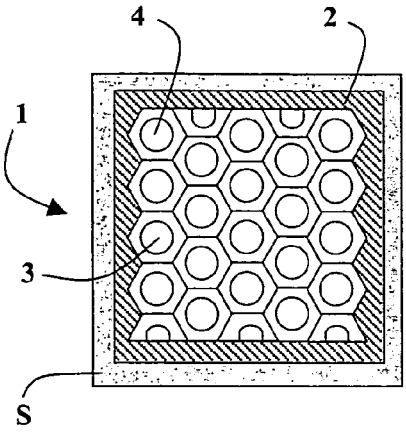
Fig. 2
Fig. 3
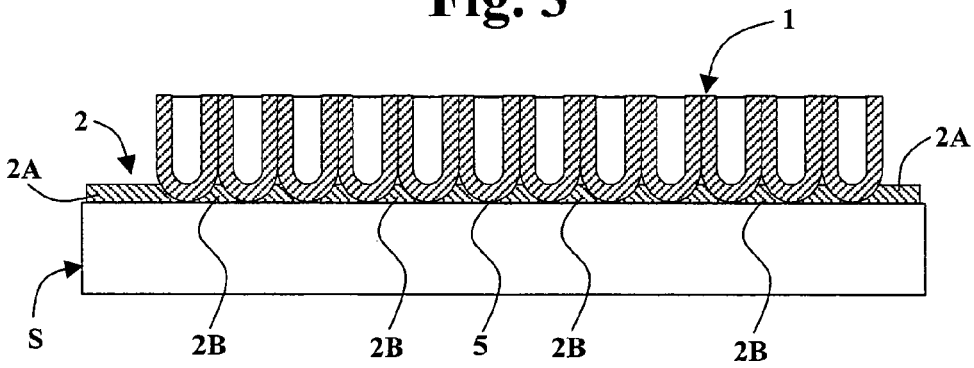
Fig. 4
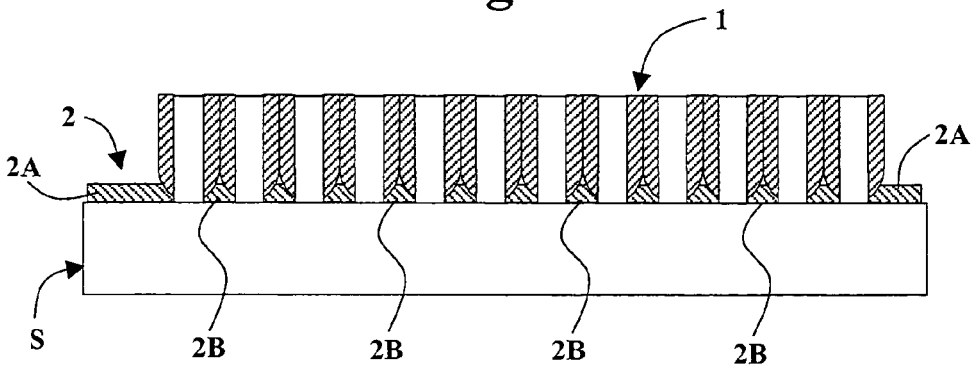

LIGHT-EMITTING DEVICE COMPRISING POROUS ALUMINA, AND MANUFACTURING PROCESS THEREOF

FIELD OF THE INVENTION

The present invention relates to a light emitting device comprising a regular porous alumina layer.

BACKGROUND OF THE INVENTION

Porous aluminum oxide ($Al_2O_3$), hereinafter referred to as porous alumina, is a transparent material with electrically insulating properties. Porous alumina, whose structure can be ideally schematized as a lattice of parallel pores in an alumina matrix, is an example of two-dimensional photonic crystal, periodical on two of its axes and homogenous on the third one. The periodicity of such structure, and thus the alternation of means with different dielectric constant, enables to determine a photonic band gap and as a result to prevent light propagation in given directions with specific energies. In particular, by controlling the size and spacing between alumina pores a band gap in the visible spectrum can be determined, with consequent iridescence effects due to reflection in the plane of incident light.

The present Applicant has previously suggested to exploit the properties of two-dimensional photonic crystal of porous alumina for reducing the emission lobe of a light source and the focalization of the light bundle as a function of period size.

To this purpose document EP-A-1 385 041 describes a light emitting device of the backlight type having a transparent substrate, to one of whose surfaces means for generating an electromagnetic radiation are associated, in which a porous alumina layer operate to inhibit propagation of the electromagnetic radiation in the directions parallel to substrate plane, thus improving the efficiency of light extraction from said substrate and increasing the directionality of emitted light. In the various possible implementations described in the above document, the means for generating the electromagnetic radiation comprise a layer of electroluminescent material to be excited by a first electrode, consisting of a metal layer, and a second electrode, consisting of a ITO film (Indium Tin Oxide), or possibly by a percolated metal layer or by a mesoporous oxide.

A light emitting device based on the use of porous alumina is also described in the article "Porous alumina based cathode for organic light-emitting device", in *Proceedings of SPIE*—The International Society for Optical Engineering, vol. 4105, 31.07.00, pages 405-412.

The device described in the above article has an alumina templating element filled up with lumino-phosphors excited by field effect, in which one of the electrodes of the device consists of an aluminum film underlying alumina. The luminescent molecules are adsorbed on the walls of alumina pores, so as to be excited thanks to the strong electric fields applied to the electrodes. In order to obtain the field effect required to enable the excitation of the luminescent molecules, the thickness of a barrier layer of alumina has to be reduced. The device has to be supplied with high voltages, required to extract sufficiently energetic electrons and to accelerate them from one electrode to the other.

SUMMARY OF THE INVENTION

The present invention aims at making a device as referred to above, which can be manufactured in an easier, faster and cheaper way than prior art as described above, though its functional properties remain the same.

These and other aims are achieved according to the present invention by a light emitting device and by a process for manufacturing a light emitting device having the characteristics as in claims 1 and 11.

Preferred characteristics of the device according to the invention and of the manufacturing process thereof are referred to in the appended claims, which are an integral and substantial part of the present description.

BRIEF DESCRIPTION OF THE DRAWINGS

Further aims, characteristics and advantages of the present invention will be evident from the following detailed description and from the accompanying drawings, provided as a mere illustrative and non-limiting example, in which:

FIGS. 1 and 2 are schematic views, namely a perspective and a plan view, of a portion of a porous alumina film of nanometric size;

FIGS. 3 and 4 are schematic views in lateral section showing two steps of a process for manufacturing a light emitting device according to the invention;

DETAILED DESCRIPTION OF THE INVENTION

Figure 5:
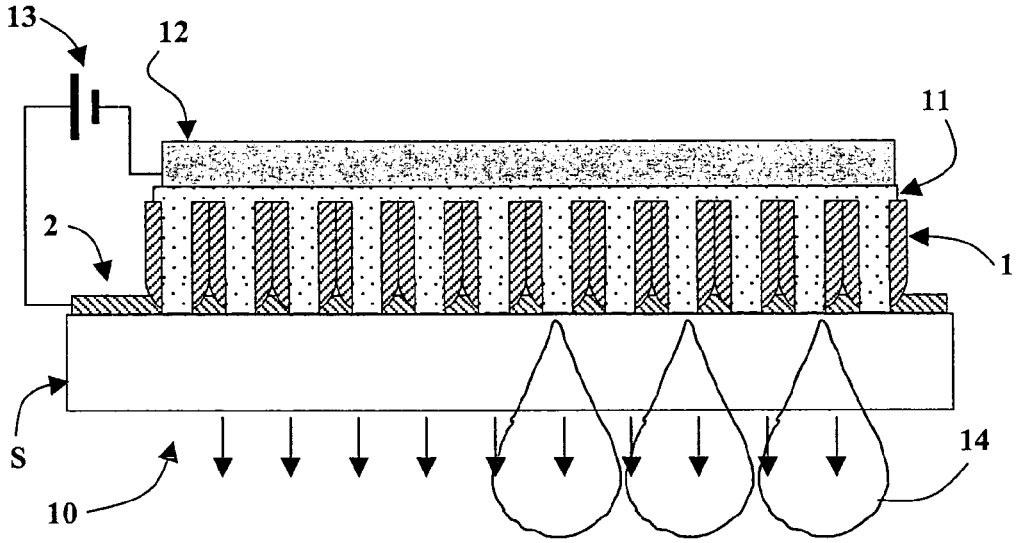
FIGS. 5, 6, 7 and 8 are schematic views in lateral section of possible embodiments of light emitting devices according to the invention.

FIGS. 1 and 2 show schematically and as a mere illustrative example a portion of a porous alumina film, globally referred to with number 1, obtained by anodic oxidation of an aluminum film 2 placed on a convenient glass substrate S. As can be seen, the alumina layer 1 comprises a series of typically hexagonal cells 3 directly close to one another, each having a straight central hole forming a pore 4, substantially perpendicular to the surface of the substrate S. The end of each cell 3 placed on the aluminum film 2 has a closing portion with typically hemispheric shape, all of these closing portions building together a non-porous part of the alumina structure, or barrier layer, referred to with number 5.

The alumina layer 1 can be developed with a controlled morphology by suitably selecting physical and electrochemical process parameters: in acid electrolytes (such as phosphoric acid, oxalic acid and sulfuric acid) and under suitable process conditions (voltage, current, stirring and temperature), highly regular porous films can be obtained. To said purpose the size and density of cells 3, the diameter of pores 4 and the height of film 1 can be varied.

The first manufacturing step for the porous alumina film 1 is the deposition of the aluminum film 2 onto a convenient substrate S, which is here made of glass or other transparent dielectric. Said operation requires a deposit of highly pure materials with thicknesses of one μm to 50 μm. Preferred deposition techniques for the film 2 are thermal evaporation via e-beam and sputtering, so as to obtain a good adhesion.

The deposition step of the aluminum film 2 is followed by a step in which said film is anodized. As was said, the anodization process of the film 2 can be carried out by using different electrolytic solutions depending on the desired size and distance of pores 4.

The alumina layer obtained through the first anodization of the film 2 has an irregular structure; in order to obtain a highly regular structure it is necessary to carry out consecutive anodization processes, and namely at least i) a first anodization of the film 2;

ii) a reduction step through etching of the irregular alumina film, carried out by means of acid solutions (for instance $CrO_3$ and $H_3PO_4$);

iii) a second anodization of the aluminum film 2 starting from the residual alumina part that has not been removed through etching.

The etching step referred to in ii) is important so as to define on the residual irregular alumina part preferential areas for alumina growth in the second anodization step.

By performing several times the consecutive operations involving etching and anodization, the structure improves until it becomes highly uniform, as schematically shown in FIGS. 1 and 2.

In the preferred embodiment of the invention, the anodization process of the aluminum film 2 is carried out so as to "wear out" almost completely the portion of the same film used for the growth of alumina 1, so that the barrier layer of alumina is locally in contact with the substrate S. The result of this process is schematically shown in FIG. 3.

As can be seen, the resulting aluminum film 2 consists of peripheral portions 2A extending on the sides of the obtained alumina structure 1, and of local portions, referred to with 2B, placed in the spaces between the hemispheric cap of one cell and the other.

After obtaining the regular porous alumina film 1 as in FIG. 2, a step involving a total or local removal of the barrier layer 5 is carried out, so that the pores 4 become holes getting through the alumina structure and facing directly the substrate S. As a matter of fact, the barrier layer 5 makes the alumina structure completely insulating from an electric point of view, and aluminum is a non-transparent material. The aforesaid process of local removal can be carried out by etching.

FIG. 4 shows schematically the result obtained after a local removal of the barrier layer. As can be seen, as a result of said removal alumina pores have an end portion delimited laterally by the portions 2B of the original aluminum film 2.

FIG. 5 shows schematically a light emitting device according to the invention, globally referred to with number 10, which comprises the basic structure as in FIG. 4, i.e. the substrate S, on which the residual parts 2A and 2B of the aluminum film 1 used for forming porous alumina are present, and on said film 2 the alumina structure 1 is also present; as can be seen, the pores of the latter are open directly onto the substrate S, close to which they are delimited by aluminum portions 2B.

In order to manufacture the device 1, the pores of the alumina structure 1 are filled up with a convenient emitting material 11; said material can be an organic material, such as an electroluminescent polymer (e.g. polyphenylene vinylene or PPV) or an organometallic material (e.g. $AlQ_3$), or an inorganic material, selected among phosphors, direct band gap semiconductors and rare-earth oxides. Said material 11 can be embedded into the alumina film 1 through techniques such as spinning, evaporation, sputtering, CVD, dipping or sol gel.

A reflecting metal film, referred to with 12, is then deposited onto the alumina structure 1 comprising the electroluminescent material 11, for instance through evaporation, sol gel, sputtering or CVD.

As can be inferred, the emitting material 11 is thus in electrical contact both with the aluminum film 2, i.e. with the portions 2B, and with the metal film 12.

The residual part of the aluminum film 2 (i.e. the portions 2A and 2B), acting as cathode, and the metal film 12, acting as anode, are connected to a convenient low voltage source, referred to with 13. The excitation of the electroluminescent material 12 is enabled by current streaming from the aluminum base under the oxidized structure, i.e. the film 2 underlying the alumina structure 1, and the metal film 12. The latter, beyond acting as cathode in the device 10, has the function of a protective layer for the emitting material 11.

In the embodiment shown in FIG. 5, light emission from the device 10, represented by the vertical arrows and by some lobes referred to with 14, takes place through the glass substrate S.

Similarly to what is disclosed in the European patent application previously referred to, the porous alumina film 1 inhibits light propagation in the directions forming greater angles with the perpendicular to the surfaces of the substrate S, in which directions total internal reflection or TIR would take place on the interfaces substrate air. The radiation fraction corresponding to said directions of propagation is then converted into radiation propagating with angles smaller than TIR angle with respect to the perpendicular, and can basically get out of the front surface of the glass substrate S. The result is a greater amount of light extracted from the device and at the same time a reduction of emission lobes 14 of light getting out of the front surface of the substrate S.

Figure 6:
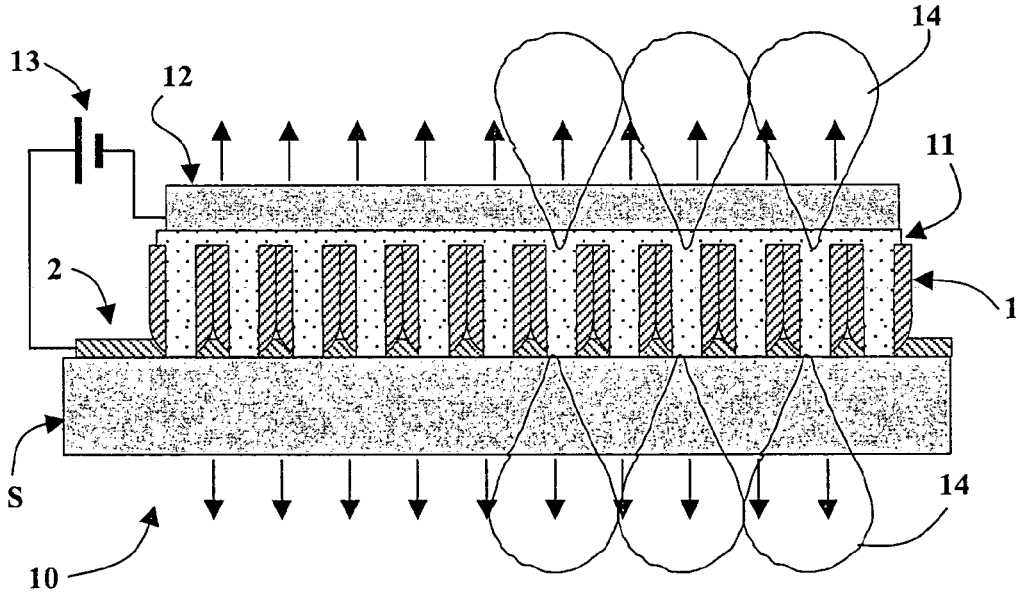

In a possible execution variant, shown in FIG. 6, the electrode 12 can be made of transparent material, so as to enable light emission on both sides of the device 10. In said implementation the conductive film 12, for instance made of percolated metal or conductive oxide, can be deposited by evaporation, sol gel, sputtering or CVD techniques.

As is known, there are various mechanisms of electron transport through an interface metal-insulator-metal, namely ohmic conduction, ionic conduction, heat emission, emission by field effect. In a given material each of the aforesaid mechanisms dominates within a given temperature and voltage range (electric field) and has a characteristic dependence on current, voltage and temperature. These various processes are not necessarily independent one from the other.

The solution suggested according to the invention envisages a device 10 in which the excitation of the electroluminescent element 11, be it organic or inorganic, is ensured in that the aforesaid electroluminescent material is in simultaneous electrical contact with both electrodes, i.e. the residual aluminum layer 2 and the conductive electrode 12 deposited above the latter.

Excitation can take place by normal electron conduction or by field effect.

In the first case, the electroluminescent material 11 consists of a continuous layer of organic or inorganic semiconductor, or of a conductive matrix into which light emitters are embedded, for instance nanocrystals or rare-earth ions or direct recombination semiconductors. Excitation is ensured in that the aforesaid material is got through by current generated by a potential difference applied to the two electrodes 2, 12.

In the second case, the electroluminescent material 11 consists of an alternation of conductive elements forming a percolated structure, for instance metal nanoparticles, and radiation spots, for instance semiconductor nanocrystals. The aforesaid radiation spots are excited through radiations by electrons emitted by field effect by the metal discontinuous structure.

Emission by field effect, also known as Fowler-Nordheim electron tunneling effect, consists in electron transport through an interface metal-insulator-metal due to tunnel effect. Said phenomenon takes place in the presence of strong electric fields, which can bend the energy bands of the insulator until a narrow triangular potential barrier is built between metal and insulator. The density of emission current by field effect strongly depends on the intensity of the electric field, whereas it is basically independent from temperature, according to the following function:

$$j = \frac{C}{\phi}(\beta E^2)\exp\left(-\frac{B\phi^{3/2}}{\beta E}\right)$$

where E is the intensity of the electric field, $\phi$ is the height of the potential barrier, B, C and $\beta$ are constants.

If applied voltage is high enough to create very strong local electric fields (E more than about $10^9$ volt/meter), there is a local increase of current density with electron conduction by tunnel effect, which enables to excite locally at nanometric level the material 11, with a subsequent light emission, as schematically shown by some lobes referred to with 14 in FIGS. 5 and 6.

Figure 7:
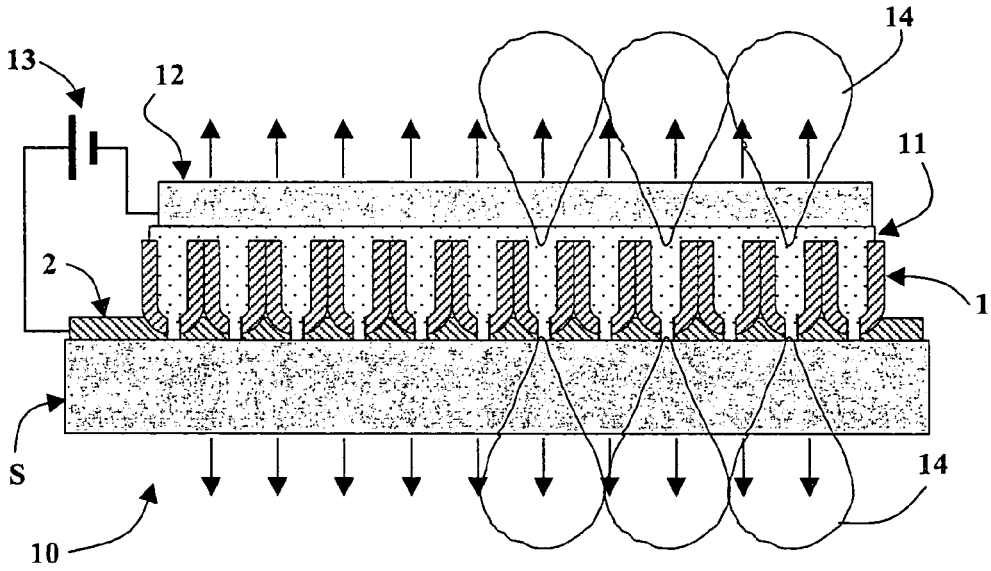

FIG. 7 shows an alternative embodiment of the device 10, in which a continuous aluminum layer is kept below the alumina structure 1, instead of local areas 2B only, as for previous embodiments.

According to said variant, after obtaining the regular porous alumina film 1, a step involving a total or local removal both of the barrier layer 5 and of the aluminum film 2 is carried out, for instance through etching, so that holes lined up with the open pores of the alumina structure are obtained in the aluminum layer 2. As was said, the barrier layer 5 makes the alumina structure completely insulating from an electric point of view, and aluminum is a non-transparent material.

The material 11 is then deposited onto the structure thus obtained, so that said material fills up the pores 4 and the corresponding holes formed in the aluminum layer 2, until it is in direct contact with the substrate S. The second electrode 12, which can be opaque or transparent, as in the case shown by way of example, is then deposited onto the structure.

Figure 8:
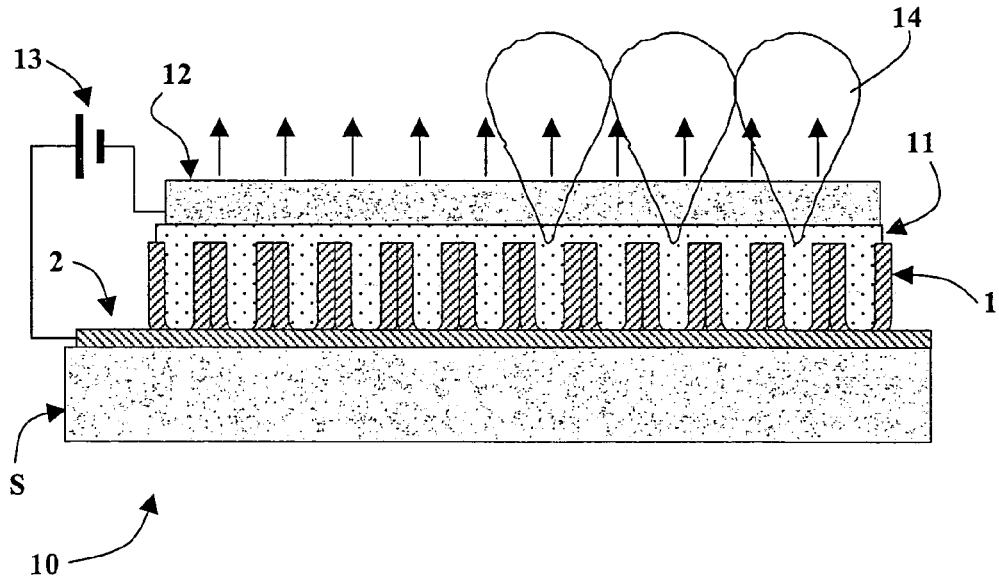

FIG. 8 shows a further possible embodiment of the device 10, in which the aluminum film used to form alumina is not completely anodized, such that a continuous aluminum layer 2 remains below the alumina structure 1. After obtaining the regular porous alumina film 1, a step involving a total or local removal of only the barrier layer 5 is carried out, for instance through etching, so that holes lined up with the open pores of the alumina structure are obtained, which holes face the aluminum layer 2. The material 11 is then deposited onto the structure thus obtained, so that said material fills up the pores 4, until it is in direct contact with the aluminum layer 2. Since aluminum is a non-transparent material, the second electrode 12 deposited onto the structure must be transparent, so as to enable light emission on the side of the device 10 opposite to the continuous aluminum layer 2.

The description above points out the features of the invention and its advantages.

According to the invention, an alumina structure is used as photonic crystal for improving light extraction and as nanometric frame of the device itself, the aluminum layer used for alumina growth acting as electrode; the use of porous alumina thus enables to obtain a regular dielectric frame ensuring electron transport between the anode, i.e. the aluminum base of alumina, and the cathode of the device.

The architecture of the device according to the invention shows through alumina pores, in correspondence of which the residual aluminum layers are placed in direct electrical contact with the electroluminescent material. The operating principle thus basically differs from the prior art as referred to above, since the excitation of radiation spots takes place either by normal excitation or by emission of local field. In the latter case radiation recombination is generated by electrons locally extracted from the conductive structure, thanks to the strong electric fields. Said peculiarity enables to supply the device according to the invention with low voltages.

Obviously, though the basic idea of the invention remains the same, construction details and embodiments can vary with respect to what has been described and shown by mere way of example.

As was said, the electroluminescent material 11 embedded between the two electrodes 2, 12 of the device 10 is an organic emitter (polymer) or an inorganic emitter (phosphors, semiconductors or rare earths) and can be in the form of a continuous film. As an alternative, the material 11 can comprise nanoparticles embedded into a conductive matrix.

In a further possible variant, the electrode 12 can comprise a percolated metal structure, provided with a protective coating so as to avoid oxidation and to preserve the electroluminescent material 11.

Other electroluminescent layers and/or charge transport layers can be embedded between the electroluminescent material 11 and a respective electrode 2, 12; thus, in this latter case, the electrical contact between the electroluminescent material 11 and a respective electrode 2, 12 is obtained through at least one charge transport layer (for instance made of PEDOT). With reference to electrode 2, after total or local removal of the barrier layer 5, a charge transport layer can be deposited onto the inner surfaces of pores 4 of the alumina film 1, to be in contact with the underlying electrode 2; the material 11 is then deposited onto the structure, so that said material fills up the pores 4, to be in direct contact with the charge transport layer, the latter being in turn in direct contact with the aluminum electrode 2.

What is claimed is:

1. A light emitting device comprising a substrate, a porous alumina layer having a regular series of substantially parallel and straight cavities of nanometric size containing an emitting material, a first electrode and a second electrode, wherein the first electrode and the second electrode are connected to an electric voltage source, both in electrical contact with the emitting material, and designed to excite said material, to cause emission therefrom of an electromagnetic radiation, and wherein said cavities are through cavities configured such that the emitting material is in direct electrical contact with said electrodes, the first electrode is arranged between the substrate and a face of the alumina layer at which an end of the through cavities opens, and comprises at least part of an aluminum film onto the substrate, on which aluminum film the alumina layer has been previously made to grow through an anodization process.

2. The device according to claim 1, wherein said cavities are shaped like through holes of the alumina layer.

3. The device according to claim 2, wherein the aluminum film includes through passages aligned with respective through cavities of the alumina layer, the emitting material being in local direct electrical contact with the aluminum film at the through passages of the aluminum film.

4. The device according to claim 1, wherein the first electrode comprises local portions of the aluminum film, which the emitting material is in direct electrical contact with, several local portions being longitudinally extended and substantially parallel one to the other.

5. The device according to claim 4, wherein said local portions build as a whole a grid-like or lattice-like structure.

6. The device according to claim 1, wherein the emitting material is organic.

7. The device according to claim 6, wherein the emitting material is an electroluminescent or organometallic polymer.

8. The device according to claim 1, wherein the excitation of the emitting material takes place by normal electron conduction, the emitting material consisting of a continuous layer of organic or inorganic material, or of a conductive matrix into which light emitters are embedded.

9. The device according to claim 1, wherein the excitation of the emitting material takes place within said cavities by field effect, where the emitting material consists of an alternation of conductive elements building a percolated structure, and radiation spots, where said radiation spots are excited with radiations by electrons emitted by field effect by the percolated structure.

10. The device according to claim 1, wherein at least one of the substrate and the second electrode is substantially transparent.

11. The device according to claim 1, wherein at least a charge transport layer is provided between the emitting material and a respective electrode.

12. The device according to claim 1, wherein the emitting material is inorganic, selected from phosphors, direct band gap semiconductors and rare-earth oxides.

13. The device according to claim 1, wherein the emitting material is a discontinuous or percolated metal structure.

* * * * *